US010629400B2

(12) United States Patent
Kataoka et al.

(10) Patent No.: US 10,629,400 B2
(45) Date of Patent: Apr. 21, 2020

(54) RELAY TERMINAL AND RELAY CONNECTOR

(71) Applicant: JAPAN AVIATION ELECTRONICS INDUSTRY, LIMITED, Tokyo (JP)

(72) Inventors: Tomoki Kataoka, Tokyo (JP); Akito Ishigaki, Tokyo (JP); Takeshi Takahashi, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 15/856,387

(22) Filed: Dec. 28, 2017

(65) Prior Publication Data

US 2018/0211803 A1 Jul. 26, 2018

(30) Foreign Application Priority Data

Jan. 26, 2017 (JP) ..... 2017-011918

(51) Int. Cl.

| | |
|---|---|
| ***H01H 45/14*** | (2006.01) |
| ***H01R 13/11*** | (2006.01) |
| *H01R 25/00* | (2006.01) |
| *H01R 13/631* | (2006.01) |

(52) U.S. Cl.

CPC ..... *H01H 45/14* (2013.01); *H01R 13/113* (2013.01); *H01R 13/6315* (2013.01); *H01R 25/006* (2013.01)

(58) Field of Classification Search

CPC .. H01H 45/14; H01R 13/113; H01R 13/6315; H01R 25/006

USPC ..... 200/51 R, 51.02, 51.07–51.09, 51.13; 74/74, 381, 654, 723, 631; 439/74, 381, 439/654, 723, 631

See application file for complete search history.

(56) References Cited

U.S. PATENT DOCUMENTS

| | | | | |
|---|---|---|---|---|
| 4,813,881 | A | 3/1989 | Kirby | |
| 4,990,110 | A | 2/1991 | Byrne | |
| 2004/0040733 | A1* | 3/2004 | Yuasa ..... | H01R 13/17 174/68.2 |

(Continued)

FOREIGN PATENT DOCUMENTS

| | | |
|---|---|---|
| EP | 1763109 | 3/2007 |
| JP | 2014-107016 | 6/2014 |

OTHER PUBLICATIONS

Office Action issued in European Patent Office (EPO) Counterpart Patent Appl. No. 18150439.0, dated Mar. 29, 2018.

*Primary Examiner* — Edwin A. Leon
*Assistant Examiner* — Lheiren Mae A Caroc
(74) *Attorney, Agent, or Firm* — Greenblum & Bernstein, P.L.C.

(57) ABSTRACT

A relay terminal includes an upper conductive and lower conductive plate, each having a plate surface intersecting with the Y direction, and a coupling part that couples the upper conductive plate and the lower conductive plate to each other. The coupling part is provided on one end in the Z direction of a combination of the upper conductive plate and the lower conductive plate, such that the coupling part connects both to a middle portion in the X direction of the upper conductive plate and to a middle portion in the X direction of the lower conductive plate. First and second pairs of contact parts are formed on the plate surfaces in end sides in the X direction of the upper and lower conductive plates, each contact part having a curved surface.

4 Claims, 18 Drawing Sheets

(56) References Cited

U.S. PATENT DOCUMENTS

2017/0201037 A1* 7/2017 Torcheux ..... H01R 13/113

* cited by examiner

FIG. 8A
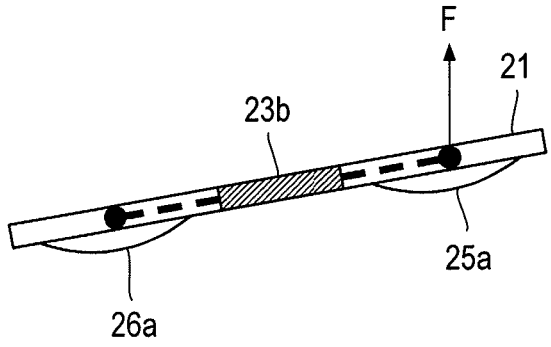
FIG. 8B
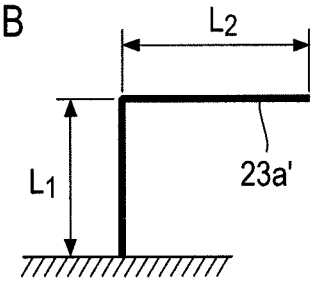
FIG. 8C
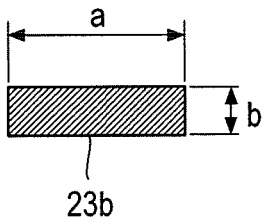
FIG. 8D
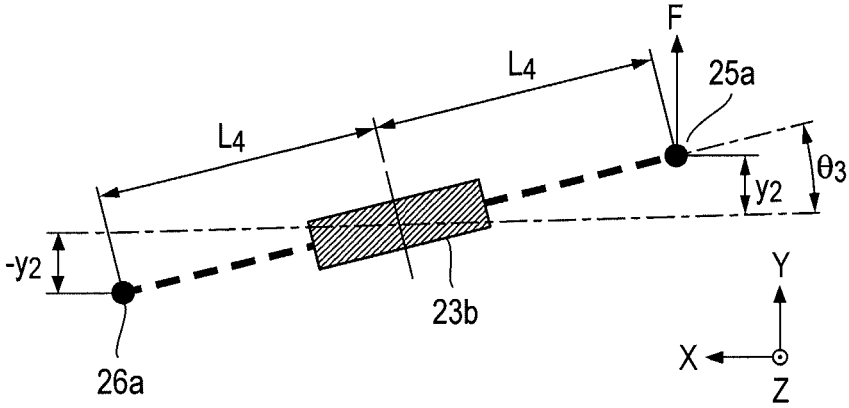
FIG. 9
| a/b | 1.0 | 1.5 | 2.0 | 2.5 | 3.0 | 4.0 | 6.0 | 8.0 | 10.0 | ∞ |
|---|---|---|---|---|---|---|---|---|---|---|
| $k_1$ | 0.208 | 0.231 | 0.246 | 0.258 | 0.267 | 0.282 | 0.298 | 0.307 | 0.312 | 0.333 |
| $k_2$ | 0.141 | 0.196 | 0.229 | 0.249 | 0.263 | 0.281 | 0.298 | 0.307 | 0.312 | 0.333 |
| $k_3$ | 0.154 | 0.136 | 0.132 | 0.133 | 0.136 | 0.141 | 0.149 | 0.154 | 0.156 | 0.167 |

$y_1>y_2$ $y_1=y_2$ $y_1<y_2$

RELAY TERMINAL AND RELAY CONNECTOR

TECHNICAL FIELD

The present invention relates to a relay terminal that electrically connects two objects to be connected to each other, and a relay connector comprising the relay terminal.

BACKGROUND ART

FIGS. 1A to 1C show a configuration of an example of a conventional relay terminal of this type described in Japanese Patent Application Laid Open No. 2014-107016 (issued on Jun. 9, 2014, referred to as Reference Literature 1 hereinafter). The relay terminal (referred to as a contact device in Reference Literature 1) has a first contact 11 and a second contact 12 opposed to each other, and a coupling part 13).

The first contact 11 has a first portion 11*a* that is to come into contact with a predetermined first conductive member, a second portion 11*b* that is to come into contact with a predetermined second conductive member, and a fulcrum portion 11*c* that is disposed between the first portion 11*a* and the second portion 11*b*, and the first portion 11*a* and the second portion 11*b* are joined to the fulcrum portion 11*c* by a first intermediate portion 11*d* and a second intermediate portion 11*e*, respectively, which are S-shaped in a side view. Furthermore, a first guide portion 11*f* is provided at a tip edge of the first portion 11*a*, and a second guide portion 11*g* is provided at a tip edge of the second portion 11*b*.

The second contact 12 has a shape symmetrical to that of the first contact 11 and, as with the first contact 11, has a first portion 12*a*, a second portion 12*b*, a fulcrum portion 12*c*, a first intermediate portion 12*d*, a second intermediate portion 12*e*, a first guide portion 12*f* and a second guide portion 12*g*.

The first contact 11 and the second contact 12 are coupled to each other at the respective fulcrum portions 11*c* and 12*c* by the coupling part 13, and each have a seesaw structure with the fulcrum portion 11*c*, 12*c* serving as a fulcrum.

A first space 14, into which the first conductive member is to be inserted, is formed between the first portion 11*a* of the first contact 11 and the first portion 12*a* of the second contact 12, and a second space 15, into which the second conductive member is to be inserted, is formed between the second portion 11*b* of the first contact 11 and the second portion 12*b* of the second contact 12.

With the relay terminal configured as described above, when the relevant conductive member is inserted into one of the first space 14 and the second space 15, a seesaw movement of the first contact 11 and the second contact 12 occurs, and the other of the first space 14 and the second space 15 narrows. This structure ensures that, when the first conductive member and the second conductive member are inserted into the first space 14 and the second space 15, respectively, a sufficient contact pressure is achieved, and the electrical connection of the relay terminal to the first conductive member and the second conductive member is maintained with reliability.

If a relay terminal that electrically connects two objects to be connected to each other has a seesaw structure, in which the objects to be connected are held on the opposite sides of the fulcrum, as with the relay terminal described above, when the object to be connected is inserted on one side, the gap on the other side narrows or is closed, so that a guide for introducing the object to be connected is needed to facilitate insertion of the object to be connected into the gap on the other side. As such a guide, the conventional relay terminal shown in FIGS. 1A to 1C has the first guide portion 11*f* and the second guide portion 11*g* on the opposite ends of the first contact 11 and the first guide portion 12*f* and the second guide portion 12*g* on the opposite ends of the second contact 12.

However, if such a guide (guide portion) is provided, the size of the relay terminal increases accordingly. Thus, such a guide hinders miniaturization of the relay terminal.

SUMMARY OF THE INVENTION

An object of the present invention is to provide a relay terminal that can be miniaturized compared with conventional relay terminals and a relay connector comprising the relay terminal.

According to the present invention, a relay terminal that is configured to connect two objects electrically to each other comprises an upper conductive plate and a lower conductive plate, each of which respectively has a plate surface intersecting with a Y direction and extending in two, an X and a Z, directions, such that the plate surfaces are disposed to be opposed to each other and separated from each other in the Y direction, provided that the X direction, the Y direction and the Z direction are three orthogonal directions, and a coupling part that couples the upper conductive plate and the lower conductive plate to each other, the coupling part being made of a conductive material, the coupling part is provided on one end in the Z direction of a combination of the upper conductive plate and the lower conductive plate, such that the coupling part connects both to a middle portion in the X direction of the upper conductive plate and to a middle portion in the X direction of the lower conductive plate, a first pair of contact parts and a second pair of contact parts are formed on the plate surfaces in one end side and another end side in the X direction, respectively, of the combination of the upper conductive plate and the lower conductive plate, each of the contact parts having a curved surface that protrudes from one of the plate surfaces, such that the first pair of contact parts oppose to each other and the second pair of contact parts oppose to each other, and when one of the two objects is inserted between the first pair of contact parts to increase a surface-to-surface distance in the Y direction between the first pair of contact parts at all points in the first pair of contact parts, an elastic deformation of the coupling part involving flexure and torsion thereof occurs such that there exists a point in one of the second pair of contact parts where a surface-to-surface distance in the Y direction between the point and a counter point in another of the second pair of contact parts remains unchanged compared with a surface-to-surface distance in the Y direction between the point and the counter point in a natural state in which the one of the two objects is not inserted between the first pair of contact parts.

With the relay terminal according to the present invention configured as described above, a distance between the second pair of contact parts does not narrow when the object is inserted into the first pair of contact parts, so that any guide (guide portion) that facilitates insertion of the objects to can be omitted, or even if there is a particular need to increase the allowable range of misalignment of the position of insertion of the objects, a smaller guide portion than conventional will suffice. Thus, the relay terminal can be miniaturized accordingly.

Since each of the contact parts has a curved surface and the first pair of contact parts oppose to each other and the second pair of contact parts oppose to each other, even if the two objects are offset from each other or rotationally misaligned (twisted) with respect to each other, the offset or rotational misalignment can be accommodated to satisfactorily connect the two objects to each other.

BRIEF DESCRIPTION OF THE DRAWINGS

FIG. 8A is a diagram used for calculation of torsion of the coupling part;

FIG. 8B is a diagram used for calculation of torsion of the coupling part;

FIG. 8C is a diagram used for calculation of torsion of the coupling part;

FIG. 8D is a diagram used for calculation of torsion of the coupling part;

FIG. 9 is a table of coefficients used for calculation of torsion of a rectangular cross section;

DETAILED DESCRIPTION OF THE EMBODIMENTS

In the following, embodiments of the present invention will be described.

FIG. 2A to 2F show a relay terminal according to an embodiment of the present invention. A relay terminal 20 comprises an upper conductive plate (hereinafter, simply referred to as an upper plate) 21, a lower conductive plate (hereinafter, simply referred to as a lower plate) 22 and a coupling part 23 and is shaped by performing a required processing on a plate material.

Figure 2A:
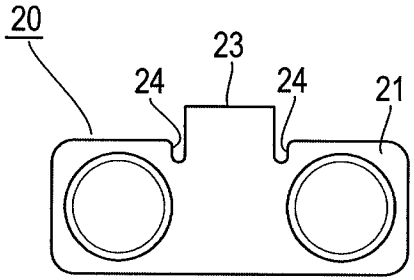
FIG. 2A is a plan view of a relay terminal according to an embodiment of the present invention.
Figure 2B:
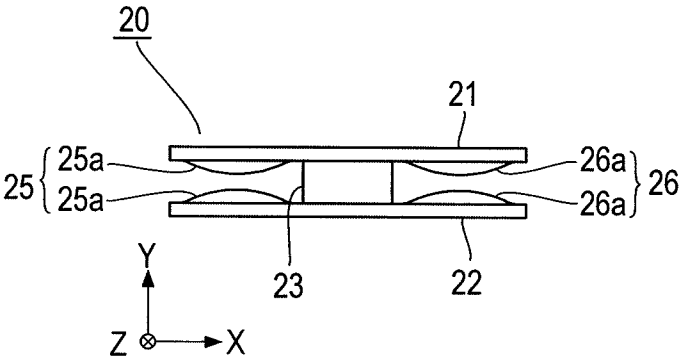
FIG. 2B is a front view of the relay terminal shown in FIG. 2A.
Figure 2C:
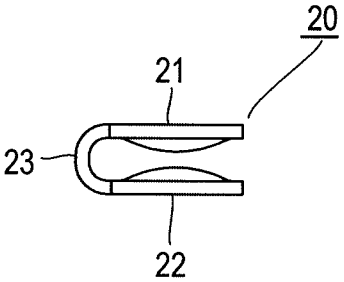
FIG. 2C is a side view of the relay terminal shown in FIG. 2A.
Figure 2D:
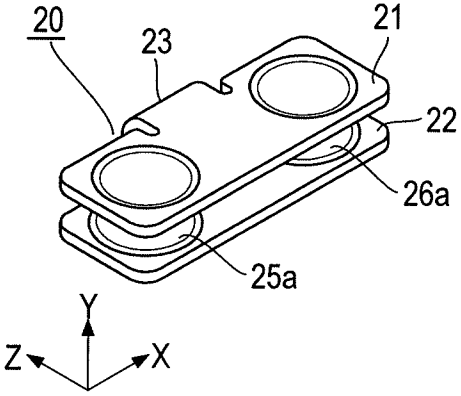
FIG. 2D is a perspective view of the relay terminal shown in FIG. 2A.
Figure 2E:
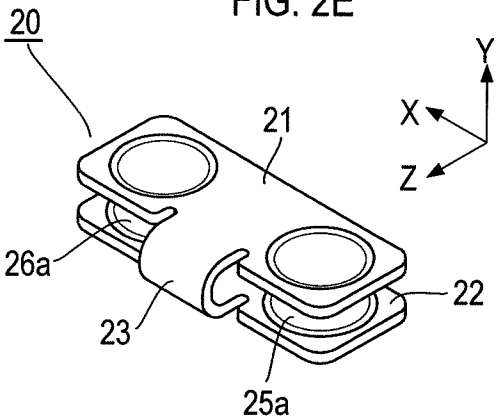
FIG. 2E is a perspective view of the relay terminal shown in FIG. 2A.
Figure 2F:
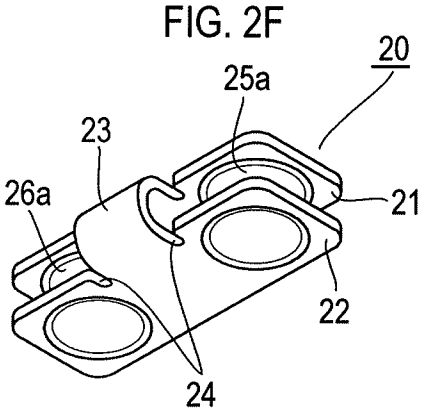
FIG. 2F is a perspective view of the relay terminal shown in FIG. 2A.

The upper plate 21 and the lower plate 22 has a rectangular shape and the same size. As shown in FIGS. 2B and 2D, provided that three orthogonal directions are denoted by an X direction, a Y direction and a Z direction, the upper plate 21 and the lower plate 22 each have a plate surface perpendicular to the Y direction and are disposed to be opposed to each other at a distance in the Y direction.

The coupling part 23 is provided to couple the upper plate 21 and the lower plate 22 to each other at a middle portion of longer sides thereof extending in the X direction on the side of one end of the upper plate 21 and the lower plate 22 in the Z direction (the direction along the shorter sides thereof). The coupling part 23 has a bent U-shape. Shallow notches 24 are formed in the longer side of each of the upper plate 21 and the lower plate 22 at which the coupling parts 23 are provided at positions across the width of the coupling part 23 in the X direction.

A first pair of contact parts 25 are provided by the upper plate 21 and the lower plate 22 on the side of one end of the coupling part 23 in the X direction, and a second pair of contact parts 26 are provided by the upper plate 21 and the lower plate 22 on the side of the other end of the coupling part 23 in the X direction. The first pair of contact parts 25 and the second pair of contact parts 26 are formed by a pair of protrusions 25*a* and a pair of protrusions 26*a*, respectively, and the protrusions of each pair have a curved shape and are formed on the opposed plate surfaces of the upper plate 21 and the lower plate 22 to protrude toward each other. The curved shape of the protrusions 25*a* and 26*a* is a part of a spherical shape in this embodiment, and the protrusions 25*a* and 26*a* have such a diameter that the protrusions 25*a* and 26*a* substantially occupy the width of the upper plate 21 and the lower plate 22 in the Z direction. In this embodiment, the protrusions 25*a* and 26*a* have the same shape, and the upper plate 21 and the lower plate 22 are symmetrical to each other with respect to the XZ plane as a plane of symmetry.

The relay terminal 20 having the shape described above is made of a conductive material, which may be a copper alloy, for example.

FIGS. 3A to 3C and FIGS. 4A to 4D show how the relay terminal 20 connects two objects to each other. The objects t may be plate-like male terminals or bus bars, for example. In this embodiment, both the two objects t are shown as plate-like male terminals. The objects have a thickness conforming to the specifications.

Figure 3A:
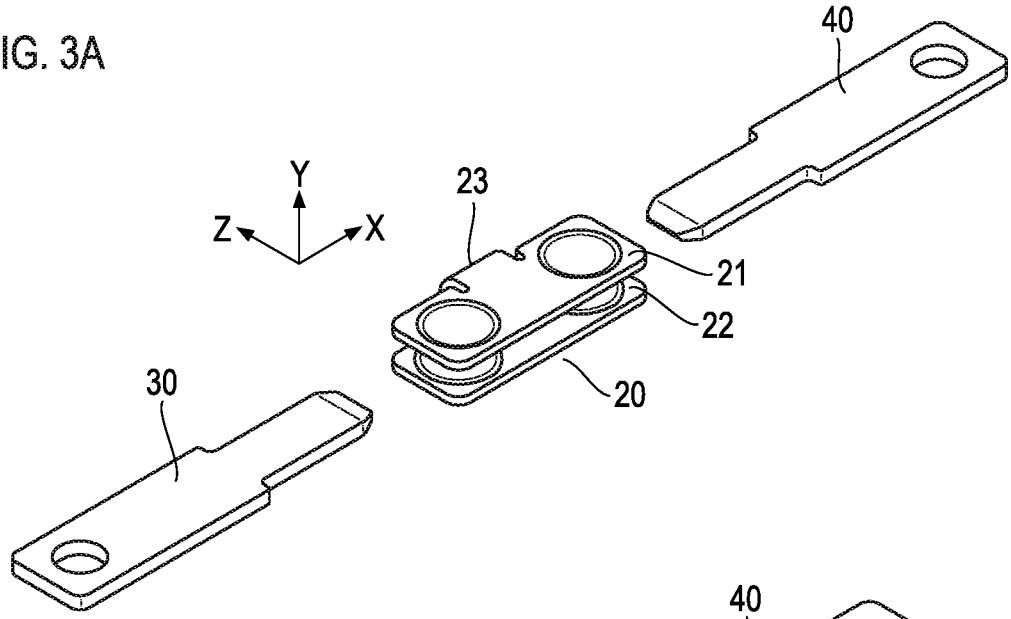
FIG. 3A is a diagram showing how the relay terminal shown in FIGS. 2A to 2F connects two male terminals to each other.
Figure 3B:
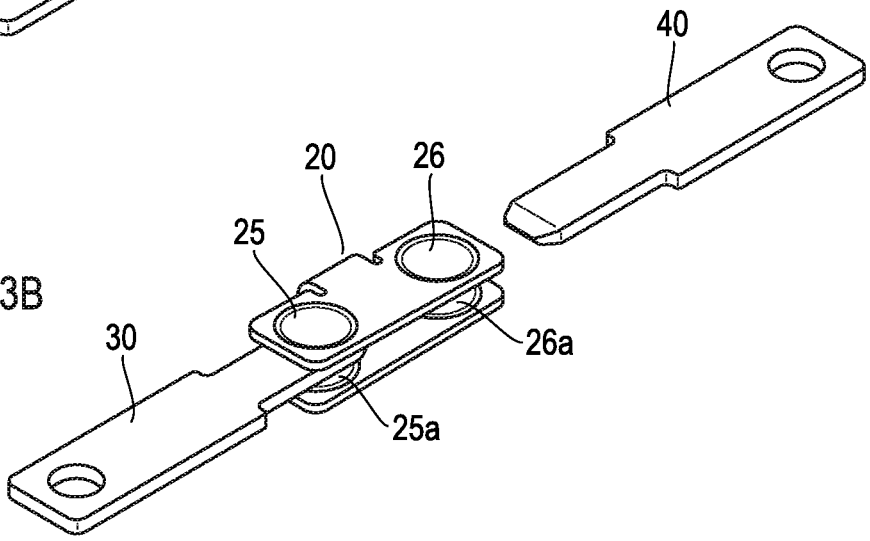
FIG. 3B is a diagram showing how the relay terminal shown in FIGS. 2A to 2F connects two male terminals to each other.
Figures 4A, 4B, 4C, 4D:
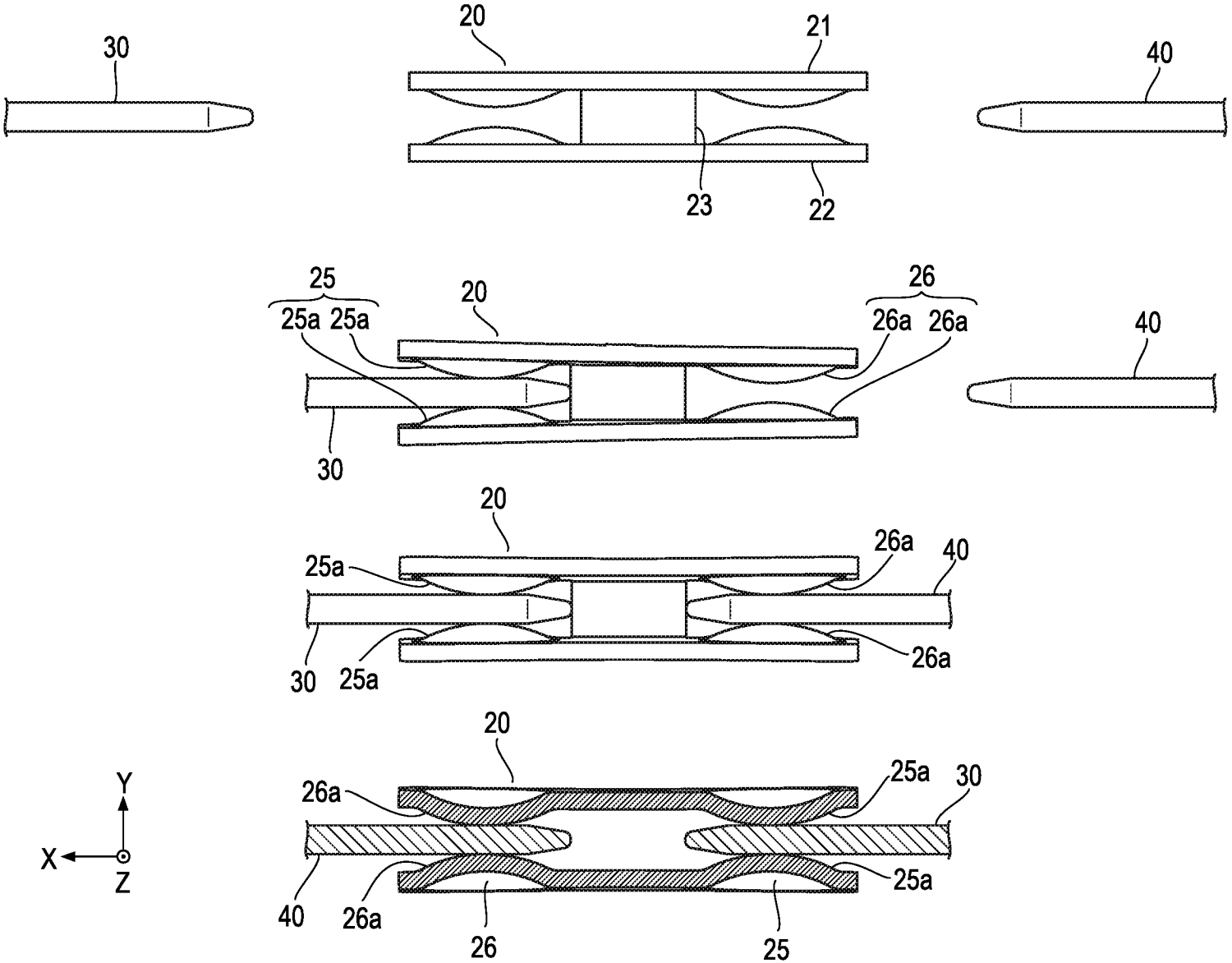
FIG. 4A is a diagram showing how the relay terminal shown in FIGS. 2A to 2F connects two male terminals to each other.
FIG. 4B is a diagram showing how the relay terminal shown in FIGS. 2A to 2F connects two male terminals to each other.
FIG. 4C is a diagram showing how the relay terminal shown in FIGS. 2A to 2F connects two male terminals to each other.
FIG. 4D is an enlarged cross-sectional view taken along the line 4D-4D in FIG. 3C.

As shown in FIGS. 3A and 4A, two male terminals 30 and 40 are connected to the relay terminal 20 on the opposite sides of the relay terminal 20 in the X direction. FIGS. 3B and 4B show a state where a male terminal 30 is first inserted between the pair of protrusions 25*a* of the first pair of contact parts 25 of the relay terminal 20. In this embodiment, when the male terminal 30 is inserted into the first pair of contact parts 25, the distance between the pair of protrusions 25*a* of the first pair of contact parts 25 increases compared with the natural state shown in FIGS. 3A and 4A, but the distance between the pair of protrusions 26*a* of the second pair of contact parts 26 remains unchanged compared with the natural state. What enables such an operation will be described in detail later.

Figure 3C:
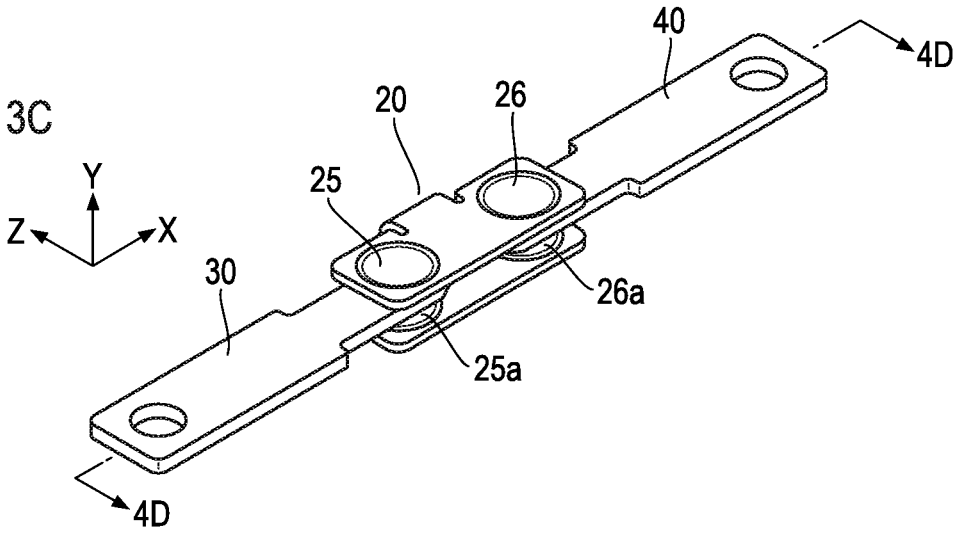
FIG. 3C is a diagram showing how the relay terminal shown in FIGS. 2A to 2F connects two male terminals to each other.

FIGS. 3C and 4C show a state where a male terminal 40 is inserted between the pair of protrusions 26*a* of the second pair of contact parts 26 and the electrical connection between the male terminals 30 and 40 by the relay terminal 20 is completed. FIG. 4D is a cross sectional view of essential parts of the structure taken along the line 4D-4D in FIG. 3C. The male terminals 30 and 40 are firmly held with a sufficient contact force between the pair of protrusions 25*a* of the first pair of contact parts 25 and between the pair of protrusions 26*a* of the second pair of contact parts 26, respectively, and thus, the male terminals 30 and 40 are satisfactorily connected to each other by the relay terminal 20.

Next, a description will be provided of the operation of the relay terminal 20 that keeps the distance between the pair of protrusions 26*a* of the second pair of contact parts 26 unchanged even when the male terminal 30 is inserted between the pair of protrusions 25*a* of the first pair of contact parts 25 as described above.

Figure 5A:
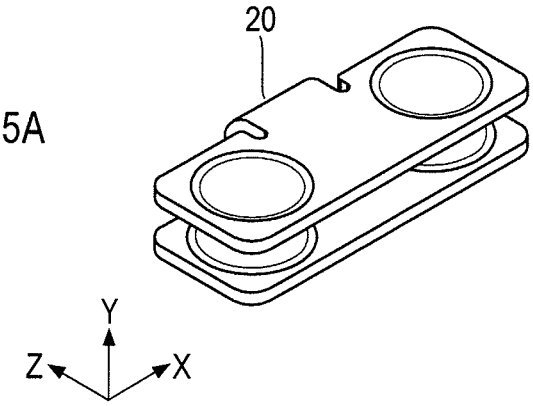
FIG. 5A is a perspective view of the relay terminal shown in FIG. 2A.
Figure 5B:
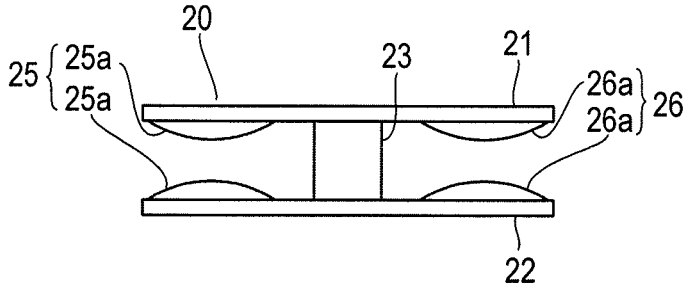
FIG. 5B is a front view of the relay terminal shown in FIG. 5A.
Figure 5C:
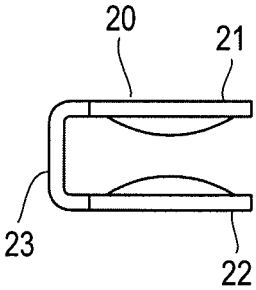
FIG. 5C is a side view of the relay terminal shown in FIG. 5A.
Figure 5D:
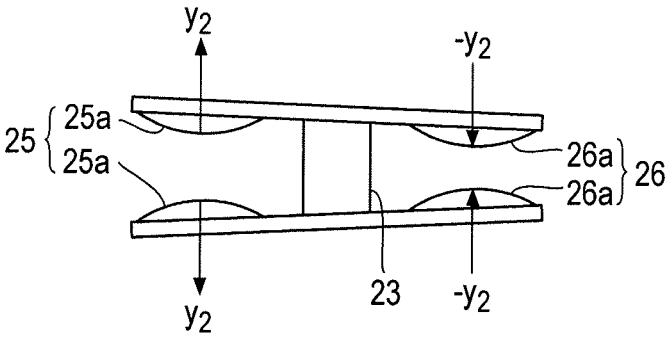
FIG. 5D is a diagram for illustrating an operation of the relay terminal shown in FIG. 5A.
Figure 5E:
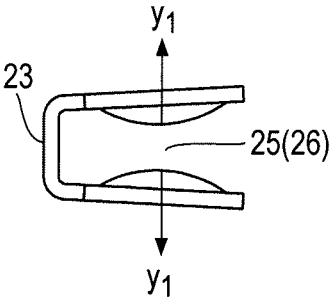
FIG. 5E is a diagram for illustrating the operation of the relay terminal shown in FIG. 5A.

FIGS. 5B and 5C schematically show the relay terminal 20 shown in FIG. 5A. FIGS. 5D and 5E schematically show two movements of the relay terminal 20 that occur when the male terminal 30 is inserted between the pair of protrusions 25*a* of the first pair of contact parts 25, although illustration of the male terminal 30 is omitted in FIGS. 5D and 5E.

Figure 5F:
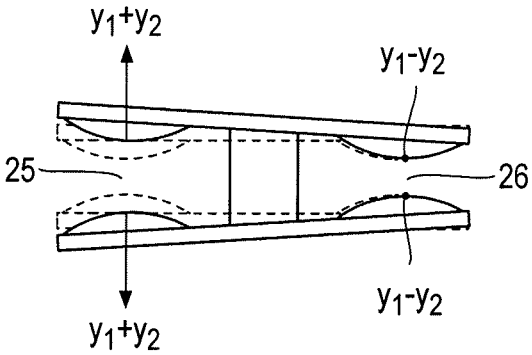
FIG. 5F is a diagram for illustrating the operation of the relay terminal shown in FIG. 5A.

In this embodiment, the relay terminal 20 makes a seesaw movement on the coupling part 23 as a fulcrum as shown in FIG. 5D and a single swinging movement in which the coupling part 23 having a U-shape opens as shown in FIG. 5E. Provided that a displacement in the Y direction of a central point of each of the protrusions 25*a* of the first pair of contact parts 25 as a result of the seesaw movement is denoted by $y_2$ and a displacement in the Y direction of a central point of each of the protrusions 26*a* of the second pair of contact parts 26 as a result of the seesaw movement is denoted by $-y_2$ as shown in FIG. 5D, and that a displacement in the Y direction of the central point of each protrusion of the first pair of contact parts 25 and the second pair of contact parts 26 as a result of the single swinging movement is denoted by $y_1$ as shown in FIG. 5E, the displacement of the central point of each of the protrusions 25*a* of the first pair of contact parts 25 that occurs when the seesaw movement and the single swinging movement occur at the same time is $y_1+y_2$, and the displacement of the central point of each of the protrusions 26*a* of the second pair of contact parts 26 is $y_1-y_2$ as shown in FIG. 5F. Thus, if a condition that $y_1-y_2=0$, that is, $y_1=y_2$, is satisfied, the position of the central point of each of the protrusions 26*a* of the second pair of contact parts 26 is kept unchanged when the male terminal 30 is inserted between the central points of the opposed protrusions 25*a* of the first pair of contact parts 25, or in other words, the distance between the pair of protrusions 26*a* is kept unchanged.

Next, how to satisfy the condition that $y_1=y_2$ will be described in detail.

Figure 6A:
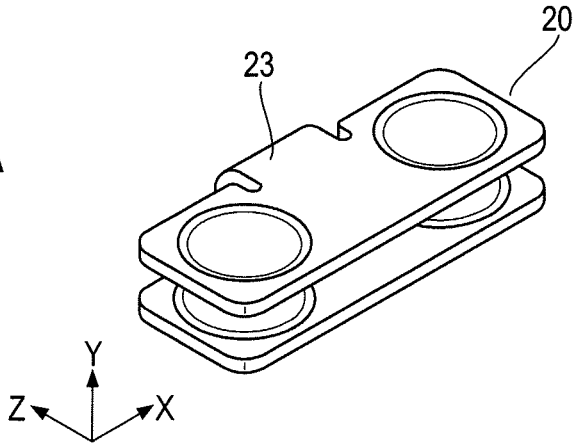
FIG. 6A is a perspective view of the relay terminal shown in FIG. 2A.
Figure 6B:
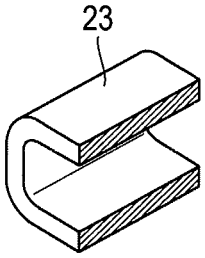
FIG. 6B is a diagram for illustrating elastic deformation of a coupling part of the relay terminal shown in FIG. 6A.
Figure 6C:
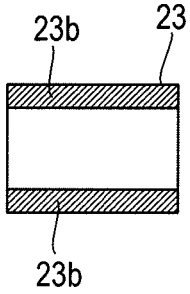
FIG. 6C is a diagram for illustrating the elastic deformation of the coupling part of the relay terminal shown in FIG. 6A.

Both the seesaw movement and the single swinging movement of the relay terminal 20 shown in FIGS. 5D and 5E are provided by elastic deformation of the coupling part 23. FIGS. 6B and 6C show the coupling part 23 cut from the relay terminal 20 shown in FIG. 6A. Flexure of the coupling part 23 as an L-shaped beam allows the single swinging movement of the relay terminal 20, and torsional deformation of the coupling part 23 allows the seesaw movement of the relay terminal 20.

Figure 6D:
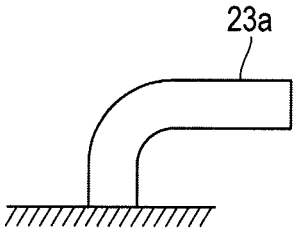
FIG. 6D is a diagram for illustrating the elastic deformation of the coupling part of the relay terminal shown in FIG. 6A.
Figure 6F:
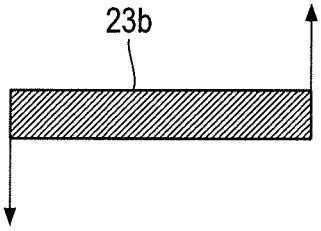
FIG. 6F is a diagram for illustrating the elastic deformation of the coupling part of the relay terminal shown in FIG. 6A.
Figure 6E:
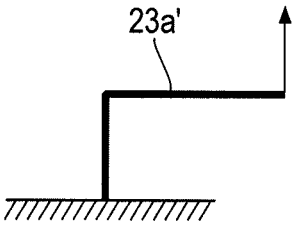
FIG. 6E is a diagram for illustrating the elastic deformation of the coupling part of the relay terminal shown in FIG. 6A.

FIG. 6D schematically shows a half portion 23*a* of the coupling part 23 having the bent U-shape, which is regarded as an L-shaped beam, and FIG. 6E shows an L-shaped beam 23*a*' that represents the half portion 23*a* in a simplified manner. FIG. 6F shows a rectangular cross section 23*b* of the coupling part 23 that undergoes torsional deformation. The arrows in FIGS. 6E and 6F show loads.

The displacement $y_1$ of the central point of each of the protrusions 25*a* and 26*a* of the first and second pair of contact parts 25 and 26 as a result of the single swinging movement can be determined as follows.

Figure 7A:
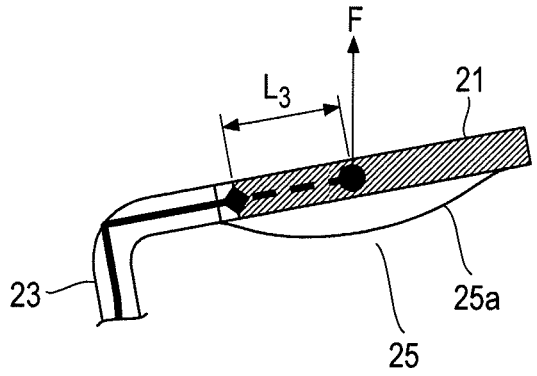
FIG. 7A is a diagram used for calculation of flexure of the coupling part as an L-shaped beam.
Figure 7B:
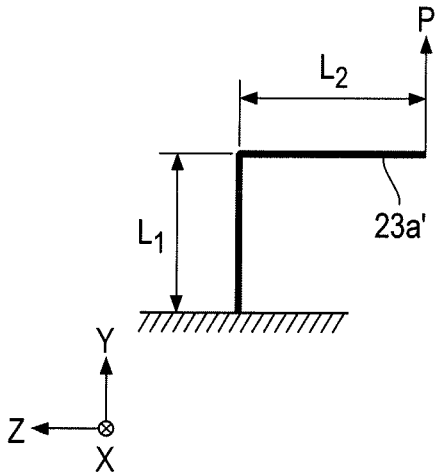
FIG. 7B is a diagram used for calculation of flexure of the coupling part as an L-shaped beam.

As shown in FIG. 7A, a contact force applied to the center of the protrusion 25*a* by the male terminal 30 when the male terminal 30 is inserted into the first pair of contact parts 25 is denoted as F. Although the point in the protrusion 25*a* at which the plate surface of the male terminal 30 parallel to the XZ plane actually comes into contact with the protrusion 25*a* is slightly displaced from the apex of the spherical protrusion 25*a*, which is the center of the protrusion 25*a* in a strict sense, that point can be used as an approximation of the apex for the following calculation. The contact force F depends on the required specifications of the relay terminal 20. Provided that a length of the vertical side of the L-shaped beam 23*a*' formed by the half portion 23*a* of the coupling part 23 is denoted by $L_1$, a length of the horizontal side is denoted by $L_2$, and a distance in the Z direction between the point at which the upper plate 21 is connected to the coupling part 23 and the center of the protrusion 25*a* is denoted by $L_3$ as shown in FIG. 7B, a force P acting on the tip end of the L-shaped beam 23*a*' is calculated as follows based on the principle of leverage.

$$P = F \times \frac{L_2 + L_3}{L_2}$$

Figure 7C:
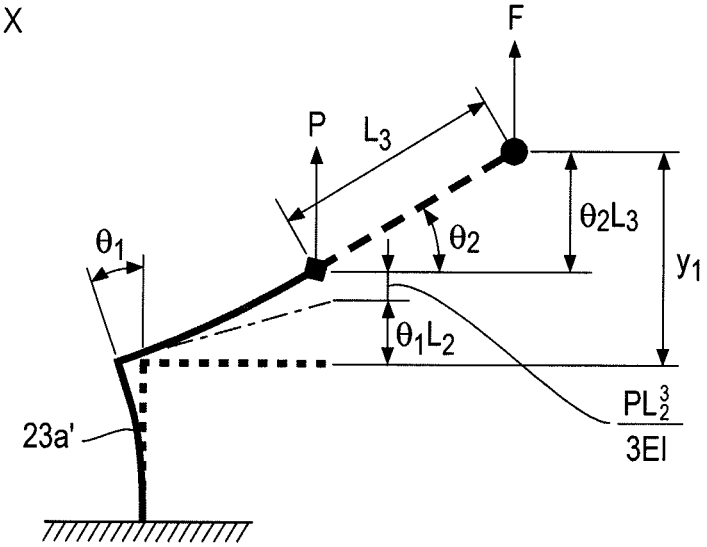
FIG. 7C is a diagram used for calculation of flexure of the coupling part as an L-shaped beam.

$\theta_1$ and $\theta_2$ are defined as shown in FIG. 7C, and the calculation about the L-shaped beam is performed. The displacement $y_1$ of the first and second pair of contact parts 25 and 26 is calculated as follows.

$$\theta_1 = \frac{PL_1^2}{EI}$$

$$\theta_2 = \frac{PL_2^2}{2EI} + \theta_1$$

$$\begin{aligned} y_1 &= \theta_2 L_3 + \frac{PL_2^3}{3EI} + \theta_1 L_2 \\ &= \frac{PL_2^2}{2EI} L_3 + \frac{PL_1^2}{EI} L_3 + \frac{PL_2^3}{3EI} + \frac{PL_1^2 L_2}{EI} \\ &= \frac{P}{6EI}(3L_2^2 L_3 + 6L_1^2 L_3 + 2L_2^3 + 6L_1^2 L_2) \end{aligned}$$

where E denotes Young's modulus, and

I denotes the moment of inertia of area.

The displacement $y_2$ of the central point of each of the protrusions 25*a* of the first pair of contact parts 25 as a result of the seesaw movement and the displacement $-y_2$ of the central point of each of the protrusions 26*a* of the second pair of contact parts 26 as the result of the seesaw movement can be determined as follows.

FIG. 8A shows a state where the upper plate 21 is in the seesaw movement under the contact force F. The seesaw movement is achieved by a torsion of the horizontal part (the range of the length $L_2$) of the L-shaped beam 23*a*' formed by the half portion 23*a* of the coupling part 23 shown in FIG. 8B. Provided that the lengths of the long and short sides of the rectangular cross section 23*b* of the coupling part 23 undergoing torsional deformation is denoted by a and b as shown in FIG. 8C, respectively, an angle of torsion co [rad/mm] per unit length of the range of the length $L_2$ is calculated as follows.

$$\omega = \frac{1}{k_2} \frac{T}{ab^3 G}$$

where T denotes a torque acting at an axis,

G denotes a modulus of transverse elasticity, and $k_2$ denotes a coefficient (a constant determined by the ratio a/b).

Thus, the angle of torsion (total angle of torsion) $\theta_3$[rad] of the range of the length $L_2$ is $\omega L_2$ ($\theta_3=\omega L_2$). Provided that a distance from the center of the rectangular cross section 23*b* of the coupling part 23 to the centers of the protrusions 25*a* and 26*a* in the X direction is denoted by $L_4$, the displacement $y_2$ shown in FIG. 8D is calculated from $L_4$ and the angle of torsion $\theta_3$ as follows.

$$y_2 = L_4 \times \theta_3$$

$$= L_4 \times \frac{1}{k_2}\frac{T}{ab^3G}L_2$$

The displacements $y_1$ and $y_2$ can be calculated as described above. The following shows an example of values of the various quantities described above that are determined to satisfy the required specifications of the relay terminal 20 and satisfy the condition that $y_1=y_2$. Note that, as preconditions (setting specifications), the distance between the centers of the pair of protrusions 25*a* of the first pair of contact parts 25 and between the centers of the pair of protrusions 26*a* of the second pair of contact parts 26 is 1.4 mm in the natural state, the thickness of the male terminals 30 and 40 is 2 mm, and the increment of the distance between the centers of the protrusions at the time when the male terminal 30 or 40 is connected is 0.6 mm.

Values Depending on Material $E=121000\ N/mm^2$, $G=43000\ N/mm^2$

Variables

F=50 N a=5 mm, b=1.2 mm $L_1=2.3$ mm, $L_2=2.7$ mm $L_3=6.1$ mm, $L_4=10$ mm

Values Calculated $P=162.962963$ N, $T=F\times L_4=500$ N·mm $I=0.72\ mm^4$, a/b=4.166666667

$k_2=0.282$ (determined from the table shown in FIG. 9)

$\theta_1=0.009895249$ rad $\theta_2=0.016713431$ rad $\theta_3=0.00477242$ rad $y_1=0.140941826$ mm $y_2=0.128855352$ mm $y_1+y_2=0.27$ mm $y_1-y_2=0.01$ mm Although the actual value of $y_1+y_2$ is (2−1.4)/2=0.3 mm, the analytical value described above, 0.27 mm, is considered as a value with an analysis error that falls within an allowable range. $y_1-y_2$ is approximately 0 as described above, that is, the condition that $y_1=y_2$ is substantially satisfied. This shows that, by appropriately selecting the dimensions and material of the relay terminal 20, the distance between the pair of protrusions 26*a* of the second pair of contact parts 26 can be kept unchanged when the male terminal 30 is inserted between the pair of protrusions 25*a* of the first pair of contact parts 25.

Figure 10A:
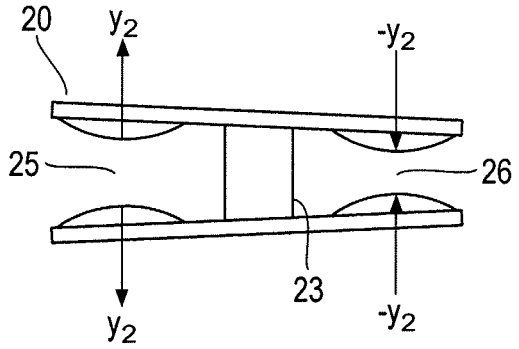
FIG. 10A is a diagram for illustrating the operation of the relay terminal.
Figure 10B:
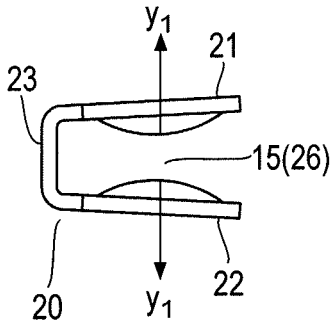
FIG. 10B is a diagram for illustrating the operation of the relay terminal.

FIG. 10A shows the displacements $y_2$ and $-y_2$ of the centers of the protrusions 25*a* and 26*a* of the first and second pair of contact parts 25 and 26 as a result of the seesaw movement as with FIG. 5D, FIG. 10B shows the displacement $y_1$ of the centers of the protrusions 25*a* and 26*a* of the first and second pair of contact parts 25 and 26 as a result of the single swinging movement as with FIG. 5E, and FIGS. 10C to 10E show how the region in which the displacement in the Y direction of the upper plate 21 (or the lower plate 22) with respect to the position of the same in the natural state falls within a range of ±0.02 mm (the region is denoted by hatching in the drawings) varies as the magnitude relationship between $y_1$ and $y_2$ varies in response to a change of the length a of the long side of the rectangular cross section 23*b* of the coupling part 23 that is undergoing torsional deformation. The state in the case where $y_1=y_2$ shown in FIG. 10D corresponds to the example of numerical analysis described above.

Figure 10C:
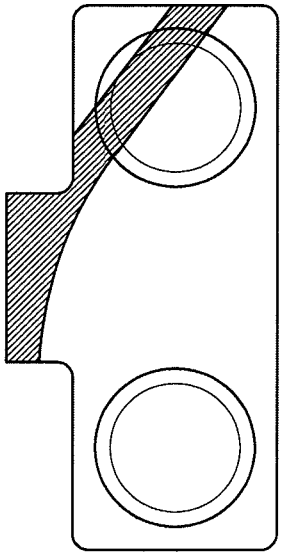
FIG. 10C is a diagram showing a displacement in a Y direction of an upper plate (or a lower plate) as a result of flexure and torsion of the coupling part as an L-shaped beam.
Figure 10D:
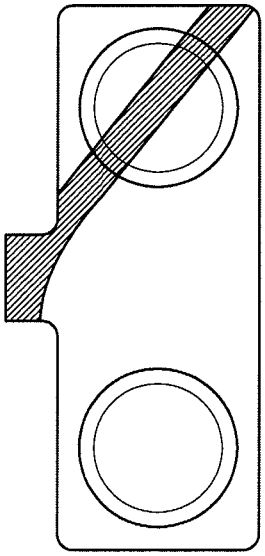
FIG. 10D is a diagram showing a displacement in the Y direction of the upper plate (or the lower plate) as a result of flexure and torsion of the coupling part as an L-shaped beam.
Figure 10E:
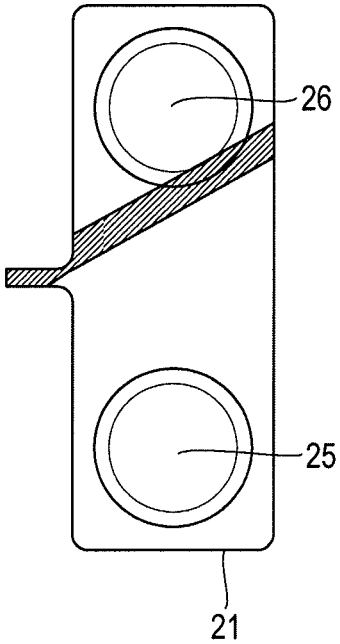
FIG. 10E is a diagram showing a displacement in the Y direction of the upper plate (or the lower plate) as a result of flexure and torsion of the coupling part as an L-shaped beam.
Figure 10E:
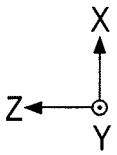

Points where the position in the Y direction remains unchanged are distributed along a line that substantially passes through the center of the hatched band-like region in each of the three cases shown in FIGS. 10C to 10E. Of these three cases, the case shown in FIG. 10D is the optimum. However, in the case shown in FIG. 10C, a point where the position in the Y direction remains unchanged when the male terminal 30 is inserted into the first pair of contact parts 25 exists in the second pair of contact parts 26, and the object of the present invention can be attained. On the other hand, in the case shown in FIG. 10E, any point where the position in the Y direction remains unchanged does not exist in the second pair of contact parts 26, and therefore the object of the present invention cannot be attained.

As described above, with the relay terminal 20 according to the present invention, even when the object is inserted into one of the first pair of contact parts 25 and the second pair of contact parts 26, there is a point where the distance between the protrusions remains unchanged in the other pair of contact parts, so that the distance between the protrusions of the other pair of contact parts does not substantially narrow. Thus, any guide (guide portion) that would be required to facilitate insertion of the object into the narrowed contact parts can be omitted, and the relay terminal can be miniaturized accordingly.

Figure 1A:
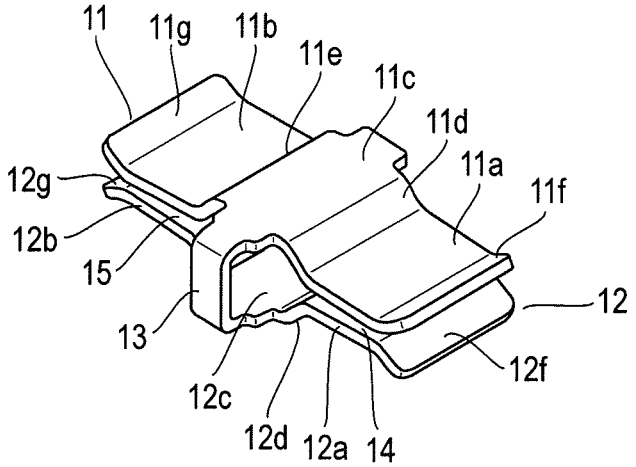
FIG. 1A PRIOR ART
FIG. 1A is a perspective view of an example of a conventional relay terminal.
Figure 1B:
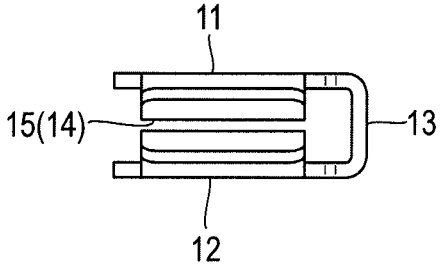
FIG. 1B PRIOR ART
FIG. 1B is a side view of the relay terminal shown in FIG. 1A.
Figure 1C:
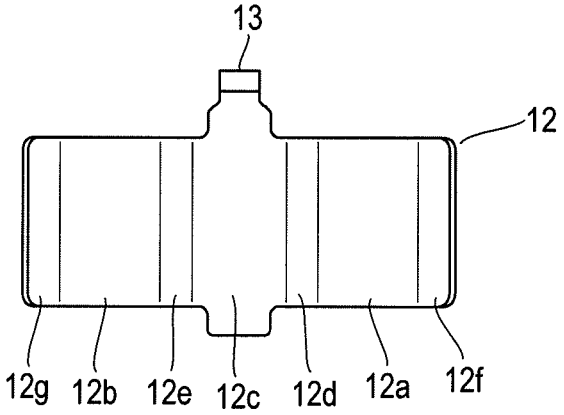
FIG. 1C PRIOR ART
FIG. 1C is a bottom view of the relay terminal shown in FIG. 1A.

As shown in FIGS. 2A to 2F, both the upper plate 21 and the lower plate 22 are a plate that has a uniform thickness and is not bent so that the position of the plate surface in the Y direction does not vary in the X direction, and the upper plate 21 and the lower plate 22 themselves are not required to be elastically deformed (i.e., the upper plate 21 and the lower plate 22 themselves are not required to have a spring property). Thus, the thickness of the upper plate 21 or the lower plate 22 can be increased, or in other words, the cross section of the upper plate 21 or the lower plate 22 can be increased, so that the relay terminal can be used for high current applications while having a small size. To the contrary, if the upper plate and the lower plate have a spring structure as with the conventional relay terminal configured as shown in FIGS. 1A to 1C, when the plate thickness is increased, a good spring property cannot be achieved. To achieve a good spring property, the length of the spring needs to be increased, so that the size of the relay terminal inevitably increases.

In this embodiment, on the other hand, since the first and second pair of contact parts 25 and 26 are formed by the pairs of protrusions 25*a* and 26*a* that have a curved shape and are opposed to each other, respectively, the relay terminal can satisfactorily connect two objects to each other even if the two objects are offset from or rotationally misaligned (or twisted) with respect to each other. FIGS. 11A to 11C and 12A to 12D show such situations.

Figure 11A:
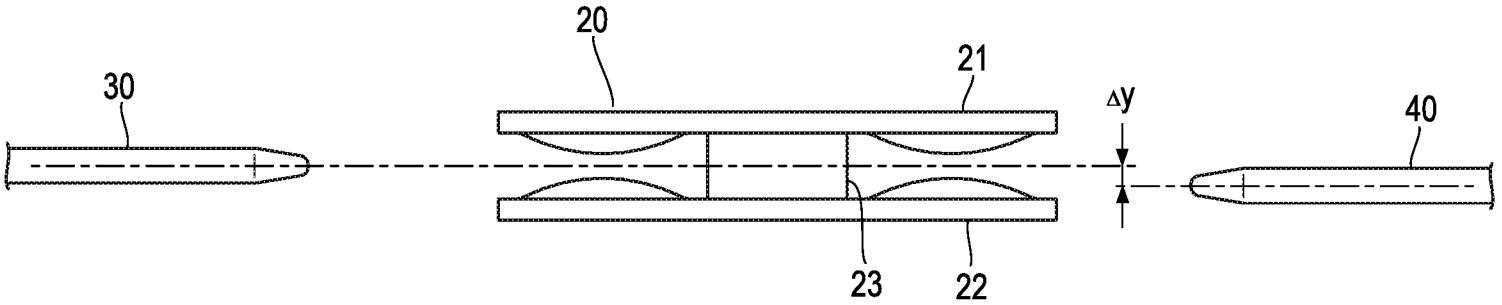
FIG. 11A is a diagram showing how the relay terminal shown in FIGS. 2A to 2F connects two male terminals offset from each other.
Figure 11B:
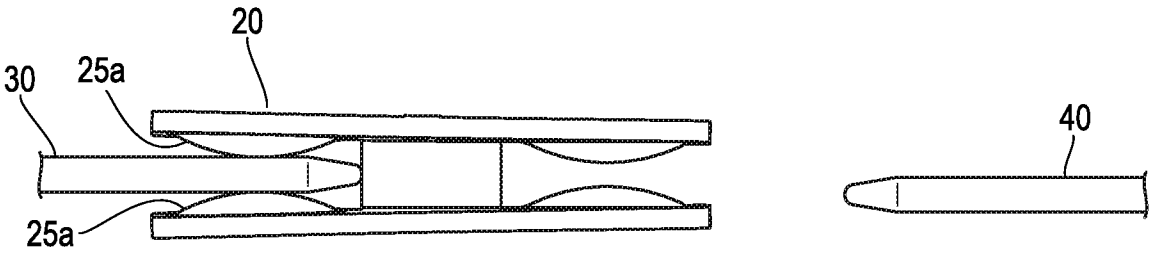
FIG. 11B is a diagram showing how the relay terminal shown in FIGS. 2A to 2F connects two male terminals offset from each other.
Figure 11C:
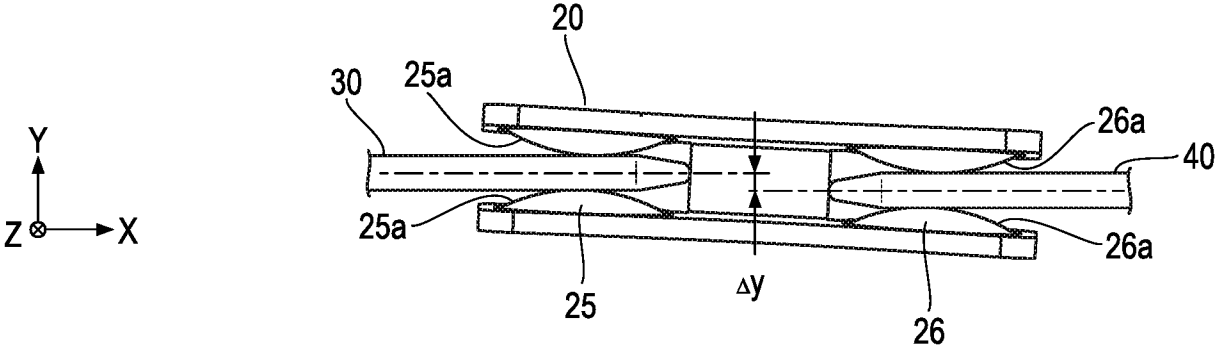
FIG. 11C is a diagram showing how the relay terminal shown in FIGS. 2A to 2F connects two male terminals offset from each other.

FIGS. 11A to 11C show a case where, when relay terminal 20 connects the two male terminals 30 and 40 to each other as in the case shown in FIGS. 4A to 4D, the male terminal 30 and 40 are misaligned by Δy in the Y direction. As shown in FIG. 11C, even if the male terminals 30 and 40 are offset from each other by Δy, the pair of protrusions 25*a* of the first pair of contact parts 25 and the pair of protrusions 26*a* of the second pair of contact parts 26 hold the respective male terminals 30 and 40 and come into contact therewith with reliability, and a good connection is achieved.

Figure 12A:
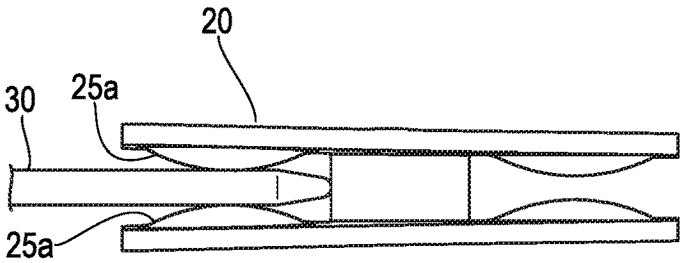
FIG. 12A is a diagram showing how the relay terminal shown in FIGS. 2A to 2F connects two male terminals rotationally misaligned (twisted) with respect to each other.
Figure 12B:
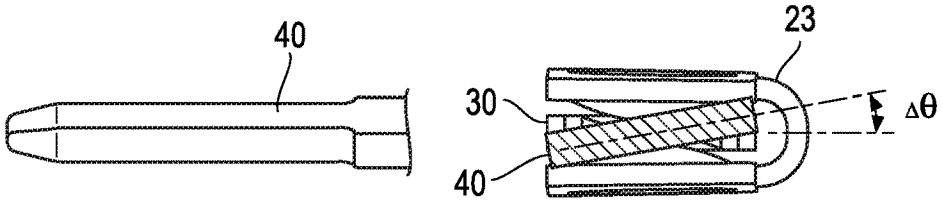
FIG. 12B is a side view of the state shown in FIG. 12A.
Figure 12C:
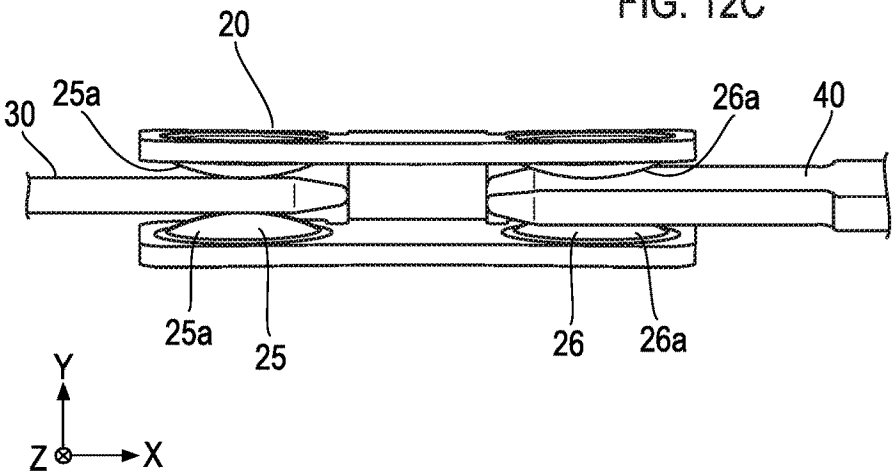
FIG. 12C is a diagram showing how the relay terminal shown in FIGS. 2A to 2F connects two male terminals rotationally misaligned (twisted) with respect to each other.
Figure 12D:
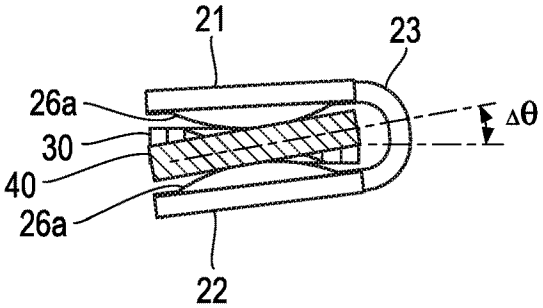
FIG. 12D is a side view of the state shown in FIG. 12C.
Figure 13A:
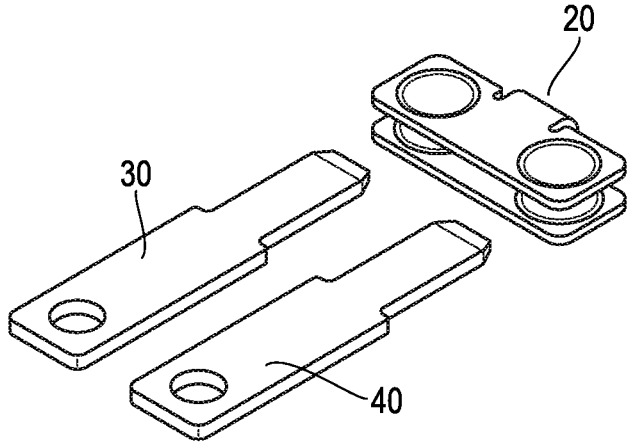
FIG. 13A is a diagram showing how two male terminals are connected to the relay terminal shown in FIGS. 2A to 2F from a direction different from the direction shown in FIG. 3A.
Figure 13B:
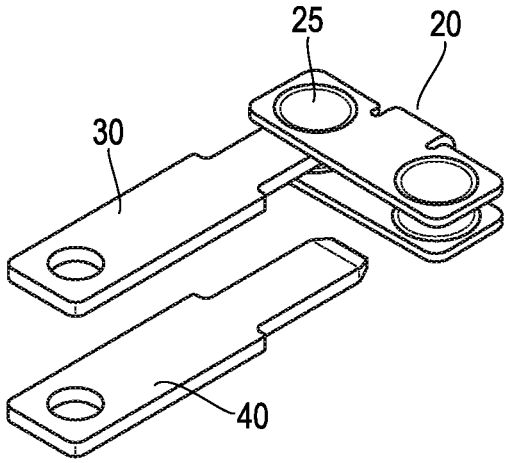
FIG. 13B is a diagram showing how two male terminals are connected to the relay terminal shown in FIGS. 2A to 2F from a direction different from the direction shown in FIG. 3A.
Figure 13C:
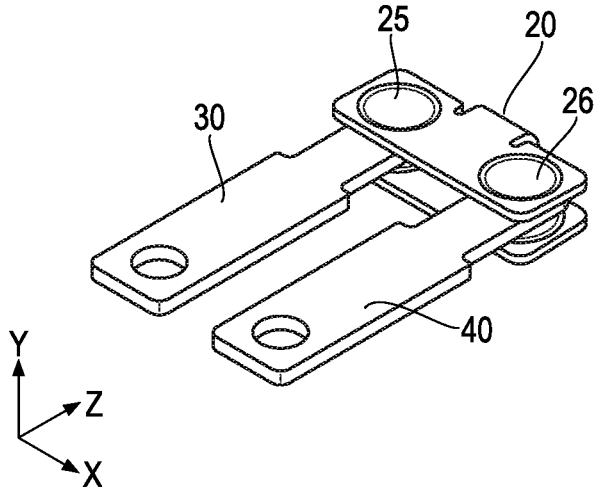
FIG. 13C is a diagram showing how two male terminals are connected to the relay terminal shown in FIGS. 2A to 2F from a direction different from the direction shown in FIG. 3A.
Figure 14A:
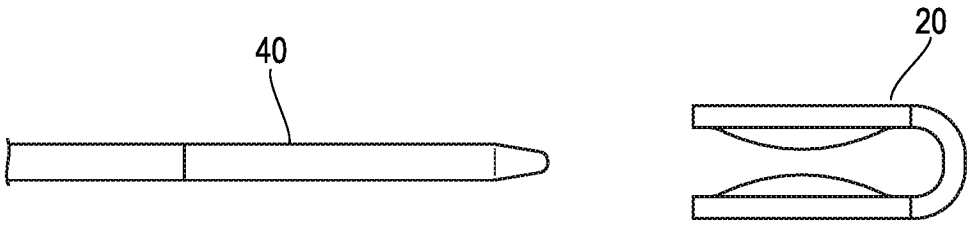
FIG. 14A is a diagram showing how two male terminals are connected to the relay terminal shown in FIGS. 2A to 2F from a direction different from the direction shown in FIG. 3A.
Figure 14B:
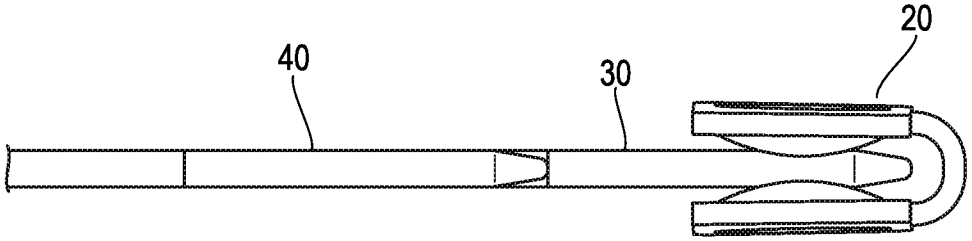
FIG. 14B is a diagram showing how two male terminals are connected to the relay terminal shown in FIGS. 2A to 2F from a direction different from the direction shown in FIG. 3A.
Figure 14C:
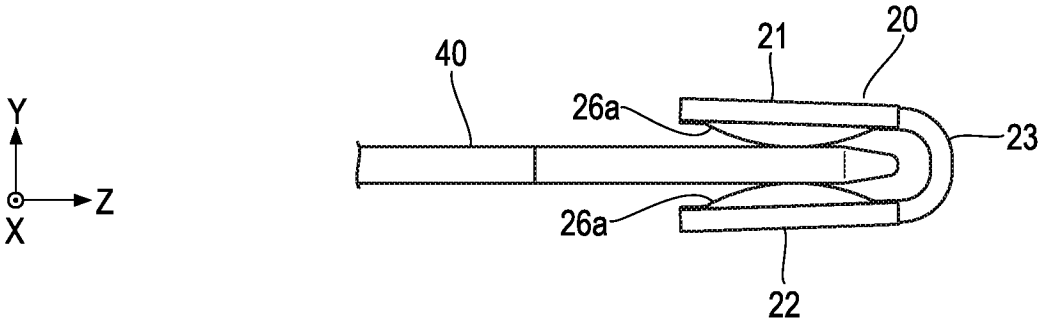
FIG. 14C is a diagram showing how two male terminals are connected to the relay terminal shown in FIGS. 2A to 2F from a direction different from the direction shown in FIG. 3A.
Figure 15A:
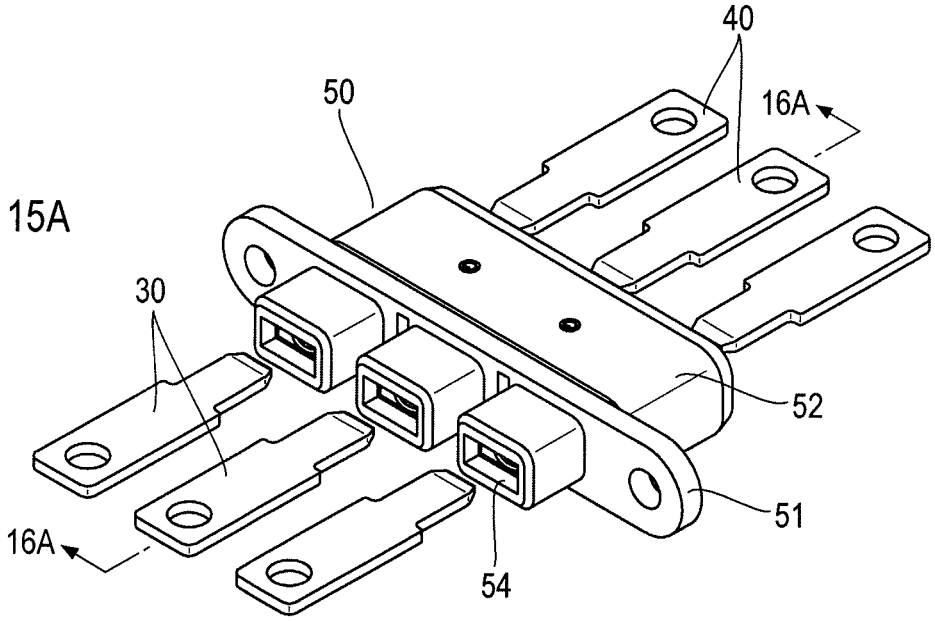
FIG. 15A is a diagram showing how a relay connector according to an embodiment of the present invention connects male terminals to each other.
Figure 15B:
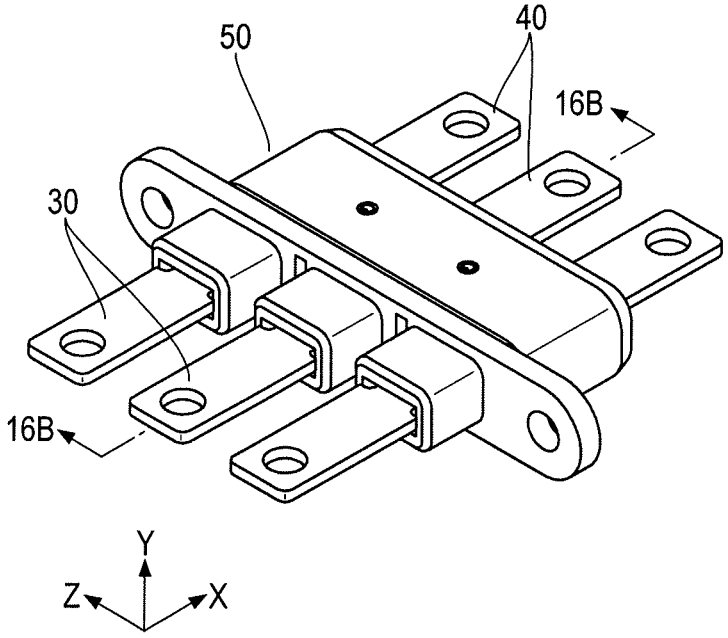
FIG. 15B is a diagram showing how the relay connector according to an embodiment of the present invention connects male terminals to each other.

FIGS. 12A to 12D shows a case where, when the relay terminal 20 connects the two male terminals 30 and 40 to each other, the male terminals 30 and 40 are rotationally misaligned by Δθ. In this case also, as shown in FIGS. 12C and 12D, the pair of protrusions 25*a* of the first pair of contact parts 25 and the pair of protrusions 26*a* of the second pair of contact parts 26 hold the respective male terminals 30 and 40 and come into contact therewith with reliability, and a good connection is achieved.

In this embodiment, the upper plate 21 and the lower plate 22 have no guide for introducing the objects to be connected, so that the direction of insertion of the objects is not limited to one direction (X direction), and the objects can be inserted into the relay terminal from another direction (other directions).

For example, FIGS. 13A to 13C and FIGS. 14A to 14C show how both the two male terminals 30 and 40 are inserted into the relay terminal 20 from the same side in the Z direction and connected to each other. In this embodiment, the two male terminals 30 and 40 can be connected in this way.

Although the relay terminal 20 can be used alone (by itself) to connect two objects to each other, the relay terminal 20 is typically housed in a housing for use.

Figure 16A:
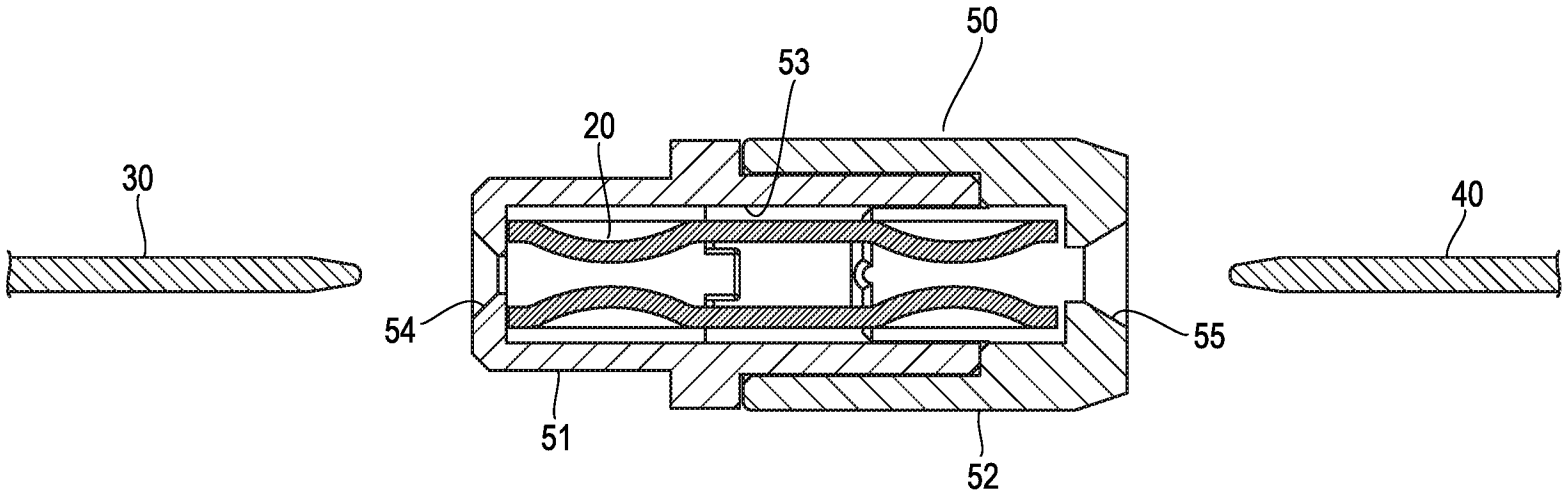
FIG. 16A is an enlarged cross-sectional view taken along the line 16A-16A in FIG. 15A.
Figure 16B:
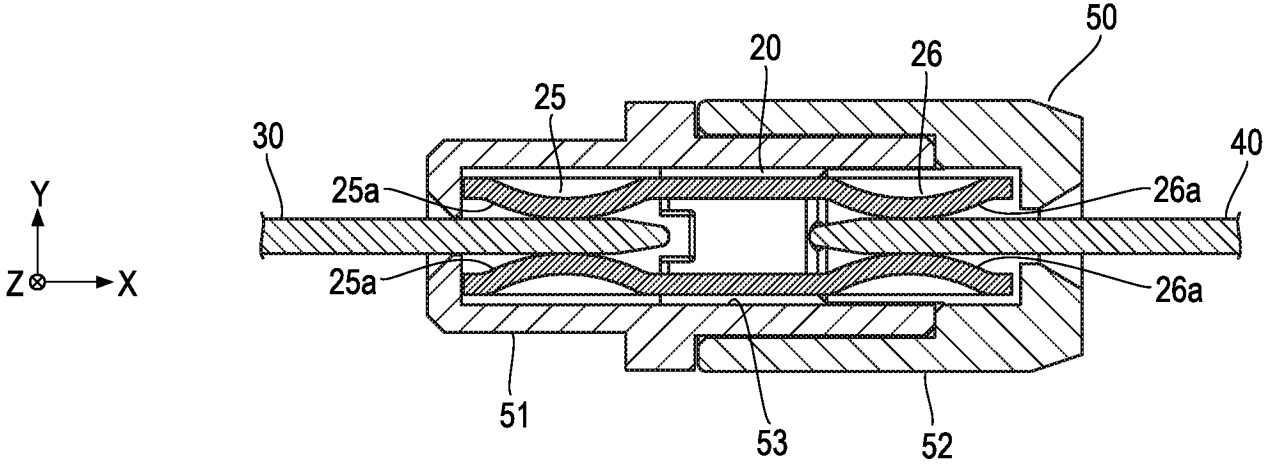
FIG. 16B is an enlarged cross-sectional view taken along the line 16B-16B in FIG. 15B.
Figure 17E:
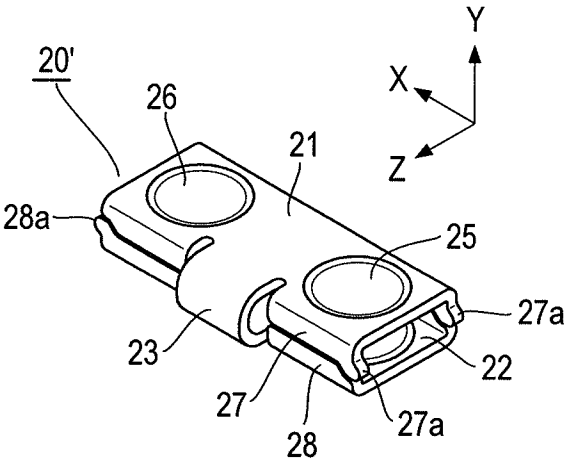
FIG. 17E is a perspective view of the relay terminal shown in FIG. 17A.
Figure 17F:
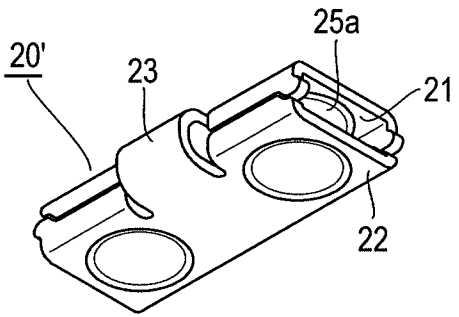
FIG. 17F is a perspective view of the relay terminal shown in FIG. 17A.
Figure 17A:
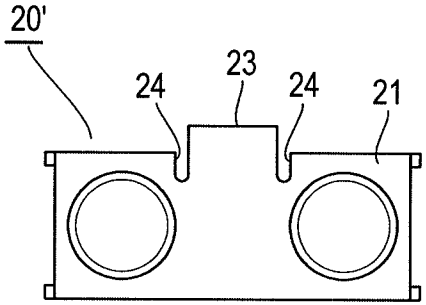
FIG. 17A is a plan view of a relay terminal according to another embodiment of the present invention.
Figure 17B:
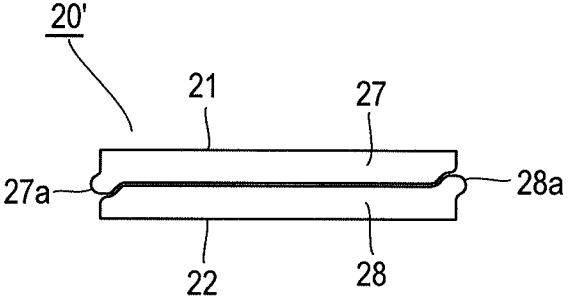
FIG. 17B is a front view of the relay terminal shown in FIG. 17A.
Figure 17D:
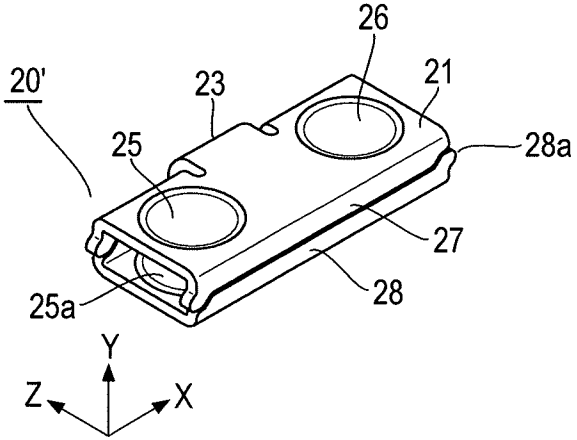
FIG. 17D is a perspective view of the relay terminal shown in FIG. 17A.
Figure 17C:
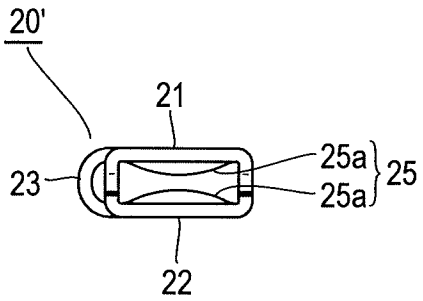
FIG. 17C is a side view of the relay terminal shown in FIG. 17A.
Figure 18A:
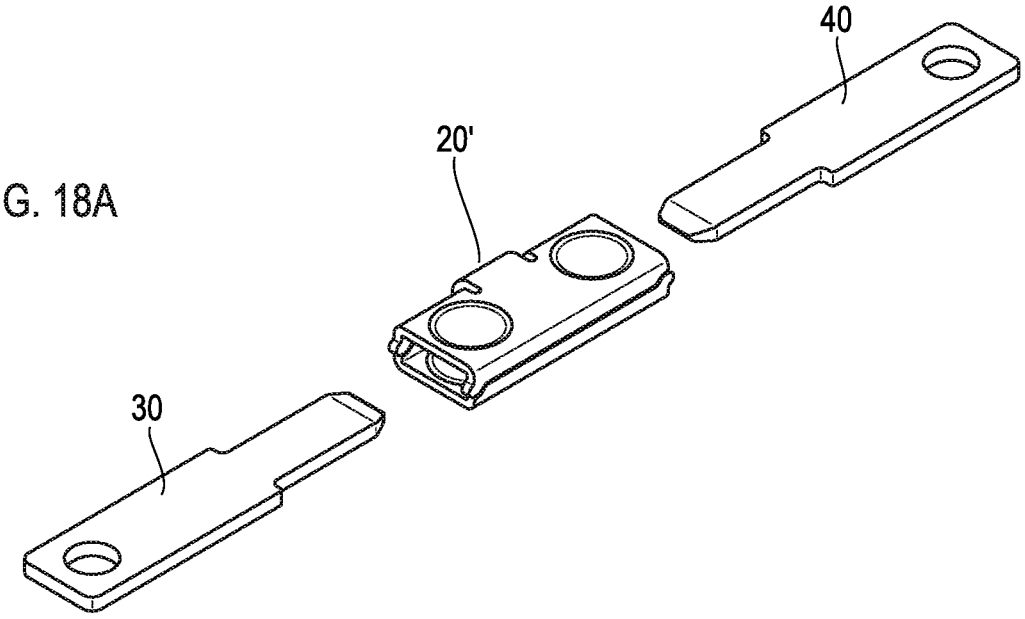
FIG. 18A is a diagram showing how the relay terminal shown in FIGS. 17A to 17F connects two male terminals to each other.
Figure 18B:
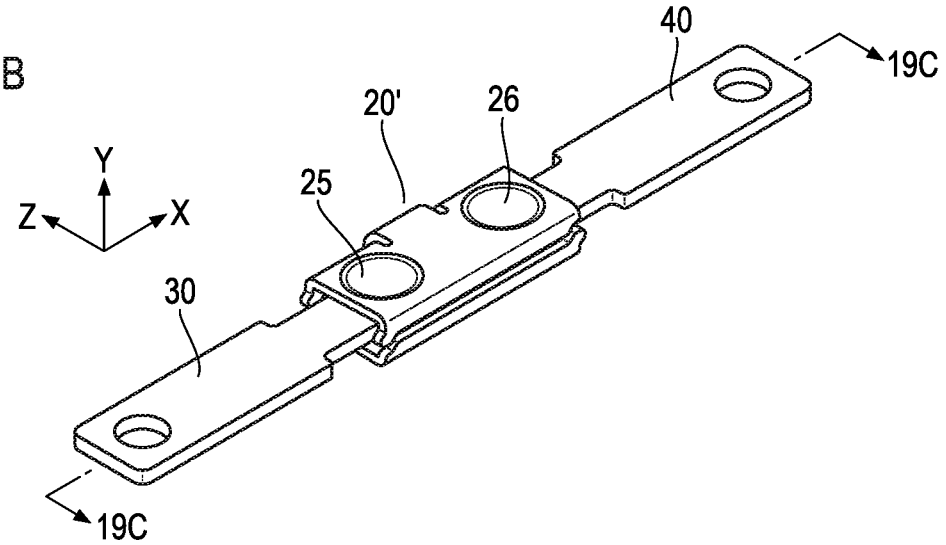
FIG. 18B is a diagram showing how the relay terminal shown in FIGS. 17A to 17F connects two male terminals to each other.

FIGS. 15A and 15B and FIGS. 16A and 16B show how a relay connector 50 comprising the relay terminal 20 in a housing connects the male terminals 30 and 40 to each other. In this example, the relay connector 50 comprises three relay terminals 20 and can connect three sets of male terminals 30 and 40. FIGS. 16A and 16B are cross-sectional views of essential parts of the structure taken along the lines 16A-16A in FIGS. 15A and 16B-16B in FIG. 15B, respectively.

In this example, the housing of the relay connector 50 comprises two housing portions 51 and 52, and the relay terminals 20 are housed in a housing space 53 formed in the housing portions 51 and 52. The relay terminals 20 are not fixed to the housing portions 51 and 52 and can move in the housing space 53. Insertion holes 54 and 55 that are in communication with the housing space 53 are formed in the housing portions 51 and 52, respectively, and the male terminals 30 and 40 are inserted into the relay terminal 20 through the insertion holes 54 and 55, respectively.

FIGS. 17A to 17F show a relay terminal according to another embodiment of the present invention, and parts common to those of the relay terminal 20 shown in FIGS. 2A to 2F are denoted by the same reference numerals.

A relay terminal 20' shown in FIGS. 17A to 17F comprises side face portions 27 and 28 that are formed as an extension by bending inwardly (in such a manner that the side face portions 27 and 28 extend to come closer to each other in the Y direction) the upper plate 21 and the lower plate 22 at the long sides thereof extending in the X direction. The side face portions 27 and 28 are formed on the opposite ends in the Z direction (along the pairs of long sides) of the upper plate 21 and the lower plate 22, respectively.

With the relay terminal 20', the direction of insertion of the objects is limited to the X direction. However, since the relay terminal 20' has a box-like shape due to the side face portions 27 and 28, the objects can be prevented from being inserted when the objects are misaligned in the Z direction. In addition, the side face portions 27 and 28 contribute to an increase of the cross-sectional area of the upper plate 21 and the lower plate 22.

Figure 19A:
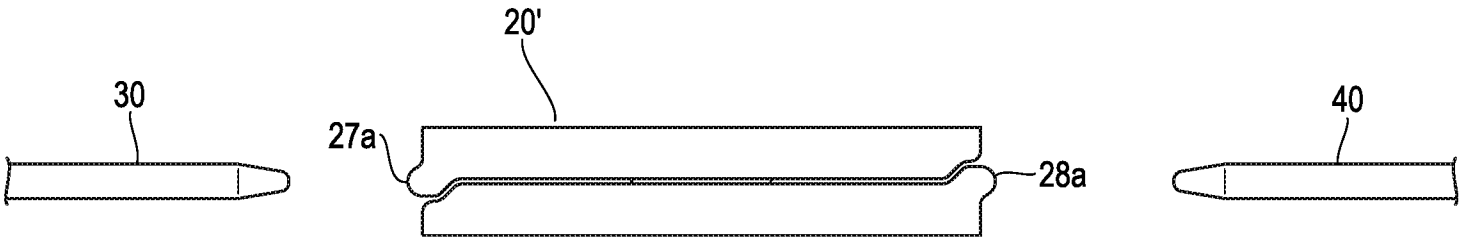
FIG. 19A is a diagram showing how the relay terminal shown in FIGS. 17A to 17F connects two male terminals to each other.
Figure 19B:
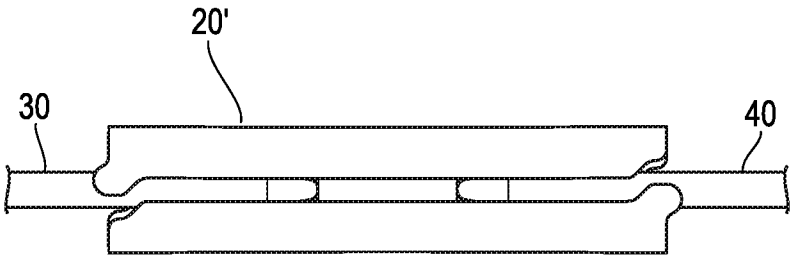
FIG. 19B is a diagram showing how the relay terminal shown in FIGS. 17A to 17F connects two male terminals to each other.
Figure 19C:
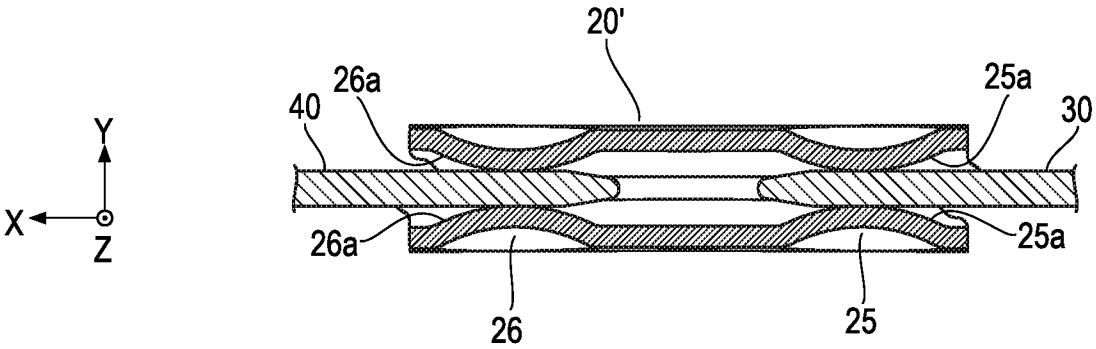
FIG. 19C is an enlarged cross-sectional view taken along the line 19C-19C in FIG. 18B.

FIGS. 18A and 18B and FIGS. 19A to 19C show how the relay terminal 20' connects the two male terminals 30 and 40 to each other, as with FIGS. 3A to 3C and FIGS. 4A to 4D. FIG. 19C is a cross-sectional view of essential parts of the structure taken along the line 19C-19C in FIG. 18B.

Projections 27*a* that are formed as an extension project from the pair of side face portions 27 are located on one end in the X direction of the relay terminal 20', and projections 28*a* that are formed as an extension project from the pair of side face portions 28 are located on the other end in the X direction of the relay terminal 20'. The tip ends of the projections 27*a* and 28*a* in the X direction are located at a midpoint of the height (dimension in the Y direction) of the relay terminal 20'. When an object to be connected having a wide portion that abuts against the side face portion 27, 28 is inserted, the projection 27*a*, 28*a* serves to position the wide portion at the midpoint of the height of the relay terminal 20'.

Although it is assumed in the embodiments described above that the upper plate 21 and the lower plate 22 are parallel to each other in the natural state and perpendicular to the Y direction, the present invention is not limited thereto. For example, the relay terminal 20 may be configured so that the distance between the plate surfaces of the upper plate 21 and the lower plate 22 narrows as it goes in the −Z direction, that is, in the direction away from the coupling part 23, and the two plate surfaces become parallel to each other when the male terminal 30 is inserted.

Furthermore, although any guide (guide portion) that facilitates insertion of the male terminals 30 and 40 are unnecessary in the embodiments shown above, the upper plate 21 and the lower plate 22 may be additionally provided with a guide portion as required, if there is a particular need to increase the allowable range of misalignment of the position of insertion of the male terminals 30 and 40 in the Y direction.

What is claimed is:

1. A relay terminal that is configured to connect two objects electrically to each other, comprising:

an upper conductive plate and a lower conductive plate, each of which respectively has a plate surface intersecting with a Y direction and extending in two, an X and a Z, directions, such that the plate surfaces are disposed to be opposed to each other and separated from each other in the Y direction, provided that the X direction, the Y direction and the Z direction are three orthogonal directions; and a coupling part having a U-shape that couples the upper conductive plate and the lower conductive plate to each other, the coupling part being made of a conductive material, wherein the coupling part is provided on one end in the Z direction of a combination of the upper conductive plate and the lower conductive plate, such that the coupling part connects both to a middle portion in the X direction of the upper conductive plate and to a middle portion in the X direction of the lower conductive plate, wherein a first pair of contact parts and a second pair of contact parts are formed on the plate surfaces in one end side and another end side in the X direction, respectively, of the combination of the upper conductive plate and the lower conductive plate, each of the contact parts having a spherically shaped surface that protrudes from one of the plate surfaces, such that the first pair of contact parts oppose each other and the second pair of contact parts oppose each other, and when one of the two objects is inserted between the first pair of contact parts to increase a surface-to-surface distance in the Y direction between the first pair of contact parts at all points in the first pair of contact parts, both of the upper conductive plate and the lower conductive plate behave as a rigid body respectively while an elastic deformation of the coupling part involving flexure and torsion thereof occurs such that there exists a point in one of the second pair of contact parts where a surface-to-surface distance in the Y direction between the point and a counter point in another of the second pair of contact parts remains unchanged compared with a surface-to-surface distance in the Y direction between the point and the counter point in a natural state in which the one of the two objects is not inserted between the first pair of contact parts, wherein the relay terminal makes both a seesaw movement on the coupling part as a fulcrum and a single swinging movement in which the coupling part having the U-shape opens, the seesaw movement being allowed by the torsion of the coupling part, the single swinging movement being allowed by the flexure of the coupling part, in such a manner that provided that a displacement in the Y direction of a central point of each of the first pair of contact parts and of a central point of each of the second pair of contact parts as a result of the seesaw movement is y2 and −y2 respectively and that a displacement in the Y direction of the central point of each of both the first pair of contact parts and the second pair of contact parts as a result of the single swinging movement is y1, a displacement in the Y direction of the central point of each of the first pair of contact parts and a displacement in the Y direction of the central point of each of the second pair of contact parts that occur when the seesaw movement and the single swinging movement occur at a same time, are y1+y2 and y1−y2 respectively.

2. The relay terminal according to claim 1, wherein each of the upper conductive plate and the lower conductive plate has a uniform thickness except for a portion of the contact parts and does not have a curvature in which a position of the plate surface in the Y direction varies curvedly along the X direction except for the portion of the contact parts.

3. A relay connector comprising the relay terminal according to claim 2.

4. A relay connector comprising the relay terminal according to claim 1.

* * * * *